United States Patent [19]

Kobayashi

[11] Patent Number: 4,836,550

[45] Date of Patent: Jun. 6, 1989

[54] CLUB HEAD FOR AN IRON-TYPE GOLF CLUB

[75] Inventor: Masashi Kobayashi, Matsudo, Japan

[73] Assignee: Maruman Golf Co., Ltd., Tokyo, Japan

[21] Appl. No.: 147,488

[22] Filed: Jan. 25, 1988

[30] Foreign Application Priority Data

Jan. 26, 1987 [JP] Japan ..... 62-15864

[51] Int. Cl.[4] ..... A63B 53/04

[52] U.S. Cl. ..... 273/167 H; 273/169; 273/80 A

[58] Field of Search ..... 273/167 H, 169, 171, 273/172, 167 F, 167 J, 78, 170, 175, 80 A

[56] References Cited

U.S. PATENT DOCUMENTS

| | | | |
|---|---|---|---|
| 645,942 | 3/1900 | Cran | 273/171 |
| 1,257,471 | 2/1918 | Fitzjohn et al. | 273/167 H |
| 3,637,218 | 1/1972 | Carlino | 273/171 |
| 4,313,607 | 2/1982 | Thompson | 273/167 H |
| 4,535,990 | 8/1985 | Yamada | 273/167 H |
| 4,645,207 | 2/1987 | Teramoto et al. | 273/167 H |

FOREIGN PATENT DOCUMENTS

| | | |
|---|---|---|
| 3819176 | 11/1961 | Japan . |
| 5565059 | 10/1978 | Japan . |

*Primary Examiner*—George J. Marlo
*Attorney, Agent, or Firm*—Armstrong, Nikaido, Marmelstein, Kubovcik & Murray

[57] ABSTRACT

A club head (10) for an iron-type golf club comprises a front wall section (11) having front side (11*a*) for hitting a ball (20). The front wall (11) is inclined backward from the bottom end thereof toward the top end thereof. A sole wall section (13) is connected at the front end thereof to the bottom end of the front wall section (11) and extends backward from the bottom end of the front wall section (11). A back wall section (14) is connected at the top end thereof to the back side of the front wall section (11) behind an impact point (P) at which the front wall section (11) is initially in contact with a ball (20) when the club head (11) is normally swung and at the bottom end thereof to the sole wall section (13). The back wall section (14) extends in perpendicular to the front wall section (11) between the front wall section (11) and the sole wall section (13). The top and bottom ends of the back wall section (13) extend between the heel and toe end of the front and sole wall sections (11, 13), respectively. A toe wall section (15) is connected to the front, sole, and back wall sections (11, 13, 14) so as to define a closed cavity (16) therebetween.

9 Claims, 3 Drawing Sheets

CLUB HEAD FOR AN IRON-TYPE GOLF CLUB

BACKGROUND OF THE INVENTION

1. Field of the Invention

The present invention relates to an improvement of a club head for an iron-type golf club.

2. Description of the Related Arts

Generally, a club head of an iron-type golf club for relatively inexperienced players should have a wide sole enabling an easy and smooth swing and to have a lower position of center of gravity thereof to easily obtain a high trajectory of flight of a ball. Further, the depth of the center of gravity of such a club head should be farther from the striking surface thereof and the moment of inertia thereof about the vertical axis passing through the center of gravity thereof should be increased in order to stabilize the direction of flight of a ball. On the other hand, such a club head also should have a shape such that the distance of flight of a ball is increased. However, when designing a club head that will meet the above-mentioned requirements, it is necessary to consider the restrictions in the total weight and loft thereof.

Japanese Patent Publication No. 38-19176 discloses a conventional iron-type golf club in which a club head having a nearly L-shaped cross-section includes a front wall section having a front side for hitting a ball, and a sole wall section. In the head of this type, the front wall section has a nearly constant thickness and is inclined backward from the bottom end toward the top end thereof to define a loft angle depending on a club number, and the sole wall section has a nearly constant thickness and extends backward from the bottom end of the front wall section. According to such a conventional club head having a nearly L-shaped cross-section, it is easy to increase the width of the sole wall section between the bottom end of the front wall section and the rear end of the sole wall section and the depth of the center of gravity thereof from the front surface of the front wall section and to lower the position of center of gravity of the head, while taking into consideration the restrictions of the total weight and loft of the head.

However, such a conventional head having a nearly L-shaped cross-section has a disadvantage in that the front wall section is easily distorted when hitting a ball, and thus the distance of flight of a ball hit by this head is decreased. Further, since the thickness of the front wall section of such a head having a nearly L-shaped cross-section is relatively thin around an impact point of the head, i.e., a point at which the head is initially in contact with a ball when the club head of the golf club is normally swung, it is difficult to effectively transfer the kinetic energy of the head to the ball, and thus the distance of flight of a ball hit by the head is shortened.

Japanese Utility Model Publication No. 55-65059 discloses a club head for an iron-type golf club which is similar to the above-mentioned club head having a nearly L-shaped cross-section, except that the thickness of the sole wall section gradually increases from the rear end thereof toward the front wall section, and thus the distribution of weight of the head is concentrated around the impact line of the head to a certain degree. Accordingly, it is possible to effectively transfer the kinetic energy of the head to a ball.

However, in the club head disclosed in Japanese Publication No. 55-65059, since the sole wall section has a cross-section having a right-angled triangle without any bore therein, it is difficult to increase the depth of the center of gravity of the head from the front surface thereof and to increase the moment of inertia about the vertical axis passing through the center of gravity of the head, and thus the direction of flight of a ball hit by the head is sometimes inaccurate.

A hollow metal head for an iron-type golf club is also known. Such a hollow metal head includes a front wall section having a front side for hitting a ball, a sole wall section extending backward from the bottom end thereof, and a back wall section extending from the top end of the front wall section to the rear end of the sole wall section. The front, sole, and back wall sections of the hollow metal head have nearly constant thicknesses, respectively, and define a closed cavity. According to the construction of such a hollow metal head, it is easy to increase the depth of the center of gravity of the head from the front side of the front wall section and the moment of inertia of the head about a vertical axis passing through the center of gravity of the head, and accordingly, the direction of flight of a ball hit by the head can be stabilized.

However, in such a hollow metal head, since there is a cavity behind the impact point of the head, the front wall section of the head is distorted when hitting a ball, and thus the distance of flight of a ball hit by the head is shortened. Further, since the weight of the head is low at the back of the impact point of the front wall section of the head, it is difficult to effectively transfer the kinetic energy of the head to a ball, and accordingly, the distance of flight of a ball hit by the head is shortened. Furthermore, since the back wall section extends to the top end of the front wall section, and thus the weight of the back wall section is increased, the center of gravity thereof is raised, and the width of the sole wall section between the bottom end of the front wall section and the bottom end of the back wall section is reduced due to the restriction in the total weight of the head. Accordingly, such a hollow metal iron type head has a disadvantage in that the trajectory of flight of a ball hit by the head is not stable, and it is difficult to ensure a smooth swing of the head.

SUMMARY OF THE INVENTION

An object of the present invention is to provide a club head for an iron-type golf club by which an easy and smooth swing can be realized and a high trajectory of flight of a ball hit thereby can be easily obtained, and by which the direction of flight of a ball hit thereby can be easily stabilized and the distance of flight of a ball hit thereby can be increased.

According to the present invention, there is provided a club head for an iron-type golf club comprising: a front wall section having a front side for hitting a ball, the front wall section being inclined backward from the bottom end thereof toward the top end thereof; a sole wall section connected at the front end thereof to the bottom end of the front wall section and extending backward from the bottom end of the front wall section; a back wall section connected at the top end thereof to the back side of the front wall section behind an impact point at which the front wall section is initially in contact with a ball when the club head is normally swung and at the bottom end thereof to the sole wall section, and extending in perpendicular to the front wall section between the front wall section and the sole wall section, the top and bottom ends of the back wall section extending between the heel and toe ends of the front and sole wall sections, respectively; and a toe wall section connected to the front, sole, and back wall sections so as to define a closed cavity therebetween.

In the club head according to the present invention, since the back wall section is connected at the top end thereof to the back side of the front wall section behind the impact point at which the front wall section is initially in contact with a ball when the club head is normally swung and at the bottom end thereof to the sole wall section, while extending in perpendicular to the front wall section between the front and sole wall sections, it is possible to effectively prevent distortion of the front wall section and to effectively transfer the kinetic energy of the head to a ball when the ball is hit by the head. Therefore, the club head according to the present invention can easily increase the distance of flight of a ball hit by the head.

Further, since the top end of the back wall section is located behind the impact point at which the front wall section is initially in contact with a ball when the club head is normally swung, it is possible to lower the center of gravity of the head while considering the restrictions of the total weight of the head.

Furthermore, since the cavity is defined by the front, sole, and back wall sections, it is possible to increase the depth of the center of gravity of the head and the moment of inertia of the head about a vertical axis passing through the center of gravity of the head while considering the restrictions of the total weight of the head. Therefore, the club head according to the present invention can stabilize the direction of flight of a ball hit by the head.

Furthermore, since the weight of the back wall section of the head according to the present invention can be decreased in comparison to the case where a back wall section extends to the top end of a front wall section, it is possible to increase the width of the sole wall section between the front and rear ends of the sole wall section. Therefore, the club head according to the present invention can be easily and smoothly swung.

These and other objects and features of the present invention will become more apparent from the following description taken in conjunction with the accompanying drawings.

DESCRIPTION OF THE PREFERRED EMBODIMENTS

Figure 1:
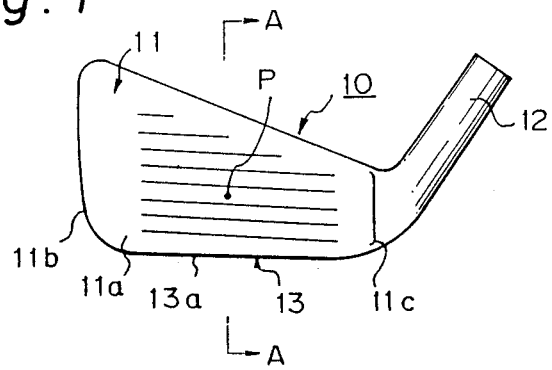
FIG. 1 is a front view of a club head for a long ion-type golf club having a long club shaft, illustrating a first embodiment of the present invention.
Figure 2:
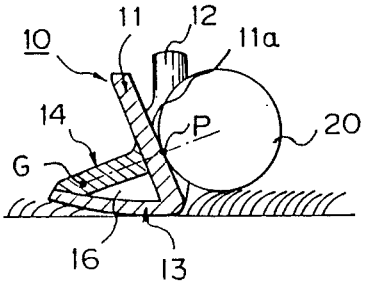
FIG. 2 is a cross-sectional view of the club head shown in FIG. 1, taken along the line A—A in FIG. 1.

FIGS. 1 to 5 illustrate a club head for a golf club of the iron type having a long club shaft. Referring to these figures, the club head 10 comprises a front wall section 11, a sole wall section 13, a back wall section 14, and a toe wall section 15. The front wall section 11 having a front side 11*a* for hitting a ball 20 has a nearly constant thickness and is inclined backward from the bottom side thereof to the top end thereof to define a predetermined loft angle depending on the club-number of the golf club. The top end of the front wall section 11 extends upward from the heel end 11*c* thereof to the toe end 11*b* thereof so that the width of the front wall section 11 between the top and bottom ends thereof is gradually increased from the heel end 11*c* to the toe end 11*b*. The front wall section 11 is provided at the heel end 11*c* thereof with a hosel portion 12 for connecting a club shaft thereto (not shown). The hosel portion 12 and at least the front wall section 11 are formed as one piece.

The sole wall section 13 having a sole side 13*a* and a nearly constant thickness is connected at the front end thereof to the front wall section 11 along the bottom end of the front wall section 11 and extending backward from the bottom end of the front wall section 11. The width of the sole wall section 13 between the front and the rear ends thereof gradually increases from the heel end of the sole wall section 13 to the vicinity of the toe end of the sole wall section 13.

The back wall section 14 having a nearly constant thickness is connected at the top end thereof to the front wall section 11 behind an impact point P at which the front wall section 11 of the club head 10 is initially in contact with the ball 20 when the club head 10 is normally swung. The top end of the back wall section 14 extends along the back side of the front wall section 11 between the heel and toe ends 11*c* and 11*b* thereof. The back wall section 14 extends backward and downward from the back side of the front wall section 11 in perpendicular to the front wall section 11 and is connected at the bottom end thereof to the sole wall section 13. The bottom end of the back wall section 14 extends along the upper side of the sole wall section 13 between the heel and toe ends thereof.

The toe wall section 15 is connected to the front, sole, and back wall sections 11, 13 and 14 so as to define a closed cavity 16, therebetween.

Preferably, the size of each of the constitutional elements of the club head 10 is decided so that the center of gravity G of the club head exists in the back wall section 14.

The front, sole, back, and toe wall sections 11, 13, 14, and 15 and the hosel portion 13 are made of a metal, for example, iron, steel, stainless steel, brass, aluminum alloy, or a fiber-reinforced metal. The cavity 16 in the club head 10 may be filled with a light material such as a foamed urethane resin.

The thickness of the front, sole, and back wall sections 11, 13, and 14 are kept within the range of from about 3 to 6 millimeters, considering the restriction of the total weight of the club head 10, depending on the club-number.

Figure 3:
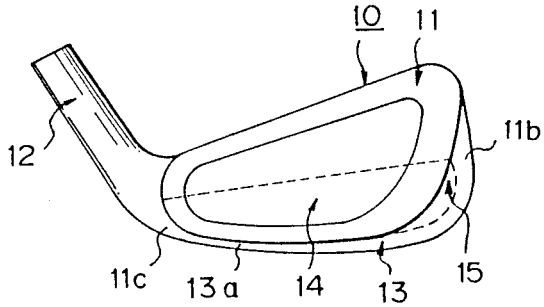
FIG. 3 is a rear view of the club head shown in FIG. 1.
Figure 4:
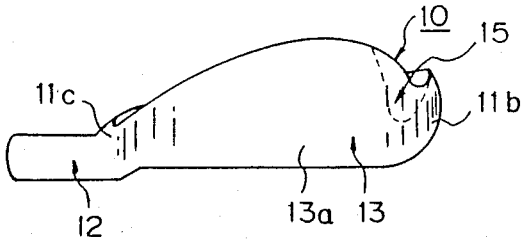
FIG. 4 is a bottom view of the club head shown in FIG. 1.
Figure 5:
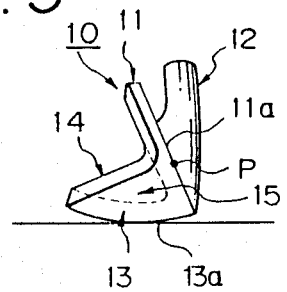
FIG. 5 is a toe side view of the club head shown in FIG. 1.

The front and sole wall sections 11 and 13 are formed in one piece together with the hosel portion 12, and the back and toe wall sections 14 and 15 are formed in one piece and fixedly attached to the front and sole wall sections 11 and 13 by welding along the dotted lines shown in FIGS. 1, 3, and 5.

In the club head having the above-mentioned construction, since the back wall section 14 is connected at the top end thereof to the back side of the front wall section 11 behind the impact point P at which the front wall section 11 is initially in contact with the ball 20 when the club head 10 is normally swung, and at the bottom end thereof to the sole wall section 13, while extending in perpendicular to the front wall section 11 between the front and sole wall sections 11 and 13, it is possible to effectively prevent distortion of the front wall section 11 and effectively transfer the kinetic energy of the head 10 to the ball 20 when the ball is hit by the head 10. Therefore, the club head 10 can easily increase the distance of flight of the ball 20 hit by the head 10.

Further, since the top end of the back wall section 14 is located behind the impact point P, it is possible to lower the center of gravity G of the head 10 while considering the restrictions of the total weight of the head 10.

Furthermore, since the cavity 16 is defined by the front, sole, and back wall sections 11, 13, and 14, it is possible to increase the depth of the center of gravity of the head 10 and the moment of inertia of the head 10 about a vertical axis passing through the center of gravity G of the head 10, while considering the restriction of the total weight of the head 10. Therefore, the club head 10 can stabilize the direction of flight of the ball 20 hit by the head 10.

Furthermore, since the weight of the back wall section 14 of the head 10 can be reduced in comparison to the case where a back wall section extends to the top end of a front wall section, it is possible to increase the width of the sole wall section 13 between the front and rear ends of the sole wall section 13, and therefore, the club head 10 can be easily and smoothly swung.

Figure 6:
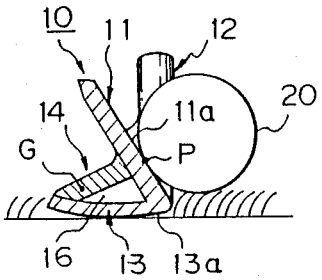
FIG. 6 is a cross-sectional view of a club head for a middle iron-type golf club having a central club shaft, illustrating a second embodiment of the present invention.
Figure 7:
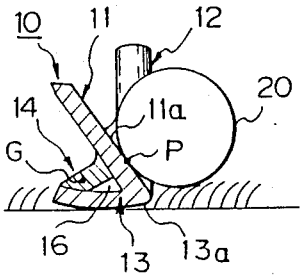
FIG. 7 is a cross-sectional view of a club head for a short iron-type golf club having a short club shaft, illustrating a third embodiment of the present invention.

FIG. 6 shows a club head for a middle iron-type golf club, and FIG. 7 shows a third embodiment of the present invention applied to a club head for a short iron-type golf club. In these figures, constitutional elements the same as in the first embodiment bear the same reference numerals.

The club head 10 shown in FIG. 6 has a loft angle larger than that of the club head 10 shown in FIGS. 1 to 5, and the club head 10 shown in FIG. 7 has a loft angle larger than that of the club head shown in FIG. 6. The height of the impact point P shown in FIG. 7 is lower than that of the impact point P shown in FIG. 6, and the latter is lower than that of the impact point shown in FIG. 2, in accordance with the difference in the loft angles, while the top ends of the back wall sections 14 shown in FIGS. 6, and 7 are located behind the impact points P of the front wall sections 11. The back wall sections 14 shown in FIGS. 6, and 7 extend backward and downward from the back sides of the front wall sections 11 and perpendicular to the front wall sections, respectively.

Figure 8:
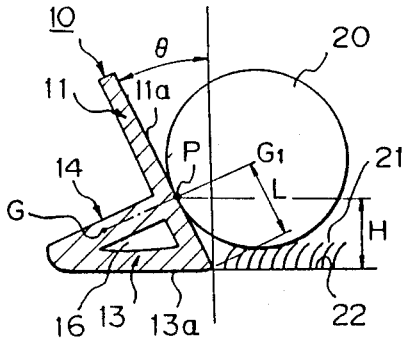
FIG. 8 shows a method for calculating the impact point of the club head according to the present invention.

FIG. 8 shows a method for calculating the impact point P of the club head 10 according to the present invention. As shown in FIG. 8, a ball 20 to be hit by an iron-type golf club is usually placed on the grass 21 and thus is separated from the ground 22 by several millimeters, for example, about 5 millimeters, and the front wall section 11 and the sole wall section 13 come into contact with the ball 20 and the ground 22, respectively, when the club head 10 is normally swung. The impact point P is calculated as a point of intersection of the front side 11*a* of the front wall section 11 with a perpendicular line drawn thereon from the center of gravity G1 of the ball 20 at the moment that the front wall section 11 is initially in contact with the ball 20.

In FIG. 8, a distance from the bottom end of the front side 11*a* of the front wall section 11 to the impact point P is denoted by a reference numeral L, and a height from the bottom end of the front side 11*a* of the front wall section 11 to the level of the impact point P is denoted by a reference numeral H. The distance L and the height H vary in accordance with the loft angle $\theta$ of the head 10, and accordingly, the position of the impact point P of each of the club heads having different loft angles $\theta$ can be found by calculating the distance L and the height H of each of the club heads in accordance with the corresponding loft angles $\theta$.

Table 1 shows an example of the distance L, the height H, and the loft angle $\theta$) of each of the club heads in a set of golf clubs including golf clubs from club number 3 to club number 9, and a pitching wedge (PW).

TABLE 1

| Club Number | $\theta$ (Deg) | H (mm) | L (mm) |
|---|---|---|---|
| 3 | 23 | 17.6 | 19.1 |
| 4 | 27 | 16.2 | 18.2 |
| 5 | 31 | 15.0 | 17.5 |
| 6 | 35 | 13.8 | 16.8 |
| 7 | 39 | 12.6 | 16.2 |
| 8 | 43 | 11.6 | 15.9 |
| 9 | 47 | 10.5 | 15.4 |
| PW | 51 | 9.6 | 15.3 |

The position of the impact point P of each of the club heads is determined in accordance with the data shown in the above-mentioned Table 1, and then the position of the top end of the back wall section 14 of each of the club heads is determined so that the top end of the back wall section 14 is located behind the impact point P and the front wall section extends along a straight line passing through the center of gravity G1 of the ball 20 and the impact point P. However, when the ball 20 is hit by the club head 10, about one third of the ball 20 is deformed and comes into contact with the front wall section 11 of the club head 10 at a certain area. Accordingly, it is not necessary to exactly determine the position of the back wall section 14; i.e., in practice, the distance L of each of the club heads having different loft angles may be within the range of from about 15 to 25 millimeters in order to determine the position of the back wall section 14 of each of the club heads.

Figure 9:
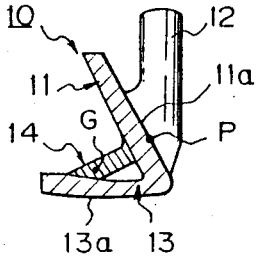
FIG. 9 is a cross-sectional view of a club head for an iron-type golf club, illustrating a fourth embodiment of the present invention.
Figure 10:
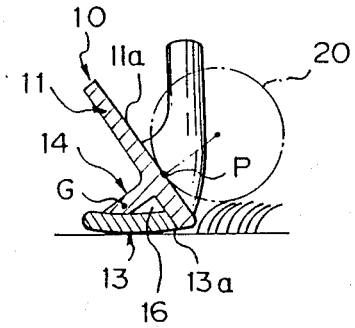
FIG. 10 is a cross-sectional view of a club head for an iron-type golf club, illustrating a fifth embodiment of the present invention.

FIGS. 9, and 10 show fourth and fifth embodiments of the present invention, respectively. In these figures, constitutional elements the same as in the first embodiment bear the same reference numerals. In the fourth embodiment shown in FIG. 9, the bottom end of the back wall section 14 is connected to the sole wall section 13 at a position apart from and in front of the rear end of the sole wall section 13. In the fifth embodiment shown in FIG. 10, the front wall section 11, the back wall section 14, and the toe wall section (not shown) are formed in one piece, and the sole wall section 13 is fixedly attached to the front, back and toe wall sections, by a welding.

I claim:

1. A club head for an iron-type golf club, comprising:

a front wall having a front side for hitting a ball, said front wall being inclined backward from the bottom end thereof toward the top end thereof:

a sole wall connected at the front end thereof to the bottom end of said front wall and extending backward from said bottom end of said front wall;

a back wall connected at the top end thereof to the back side of said front wall behind an impact point at which said front wall is initially in contact with a ball when said club head is normally swung and at the bottom end thereof to said sole wall, and extending in substantially perpendicular to said front wall between said front wall and said sole wall, said top and bottom ends of said back wall extending between the heel and toe ends of said front and sole walls, respectively; and a toe wall connected to said front, sole, and back walls for defining a closed cavity therebetween.

2. A club head according to claim 1, wherein the center of gravity of said head exists in said back wall section.

3. A club head according to claim 1, wherein said front wall is integrally coupled to said sole wall and said back wall is fixedly attached to said front and sole walls.

4. A club head according to claim 1, wherein said front, back, and toe walls are integrally coupled to each other, and said sole wall is fixedly attached to said front, back, and toe walls.

5. A club head according to claim 1, wherein said front wall is provided at said heel end thereof with a hosel portion for connecting a club shaft thereto, said hosel portion and at least said front wall being formed in one piece.

6. A club head according to claim 1, wherein each of said front, sole, and back walls has a nearly constant thickness.

7. A club head according to claim 1, wherein said front, sole, back, and toe walls are made of metal.

8. A club head according to claim 1, wherein the width of said front wall between said top and bottom ends thereof gradually increases from said heel end thereof to said toe end thereof.

9. A club head according to claim 1, wherein the width of said sole wall between said front end thereof and the rear end thereof gradually increases from said heel end of said sole wall to the vicinity of said toe end of said sole wall.

* * * * *